US007556028B2

(12) United States Patent
Higaki et al.

(10) Patent No.: US 7,556,028 B2
(45) Date of Patent: Jul. 7, 2009

(54) FOUR CYCLE INTERNAL COMBUSTION ENGINE AND VEHICLE

(75) Inventors: Yoshiyuki Higaki, Shizuoka (JP); Osamu Takii, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/013,531

(22) Filed: Jan. 14, 2008

(65) Prior Publication Data

US 2008/0168967 A1 Jul. 17, 2008

(30) Foreign Application Priority Data

Jan. 15, 2007 (JP) ..... 2007-006375

(51) Int. Cl.
*F02B 47/08* (2006.01)
*F02M 25/07* (2006.01)

(52) U.S. Cl. ..... 123/568.13; 123/58.8

(58) Field of Classification Search ..... 123/58.8, 123/302, 568.11, 568.13
See application file for complete search history.

(56) References Cited

U.S. PATENT DOCUMENTS 4,156,414 A 5/1979 Kawamura et al.
4,422,430 A * 12/1983 Wiatrak ..... 123/568.13
4,813,232 A * 3/1989 Hitomi et al. ..... 60/313
5,690,081 A 11/1997 Kwiatkowski
6,178,933 B1 1/2001 Lavy
6,427,644 B1 8/2002 Dabadie et al.
7,028,648 B2 * 4/2006 Hasegawa et al. ..... 123/58.8
2004/0065279 A1 * 4/2004 Hitomi et al. ..... 123/58.8
2004/0123820 A1 7/2004 Hasegawa et al.
2005/0022755 A1 * 2/2005 Hitomi et al. ..... 123/58.8

FOREIGN PATENT DOCUMENTS

DE 196 42 685 A1 4/1998
JP 5-86992 A 4/1993

OTHER PUBLICATIONS

Official communication issued in counterpart European Application No. 08 25 0131, completed on Apr. 21, 2008.

* cited by examiner

*Primary Examiner*—Stephen K Cronin
*Assistant Examiner*—Anthony L Bacon
(74) *Attorney, Agent, or Firm*—Keating & Bennett, LLP

(57) ABSTRACT

A four-cycle internal combustion engine is constructed such that a structure around a cylinder head is not complicated even though the engine has a plurality of cylinders, fuel consumption is improved, and nitrogen oxides are reduced. The engine has cylinder-sided passages, through which burnt gasses pass. Also, the engine includes an inter-cylinder passage in communication with the cylinder-sided passages.

12 Claims, 4 Drawing Sheets

FOUR CYCLE INTERNAL COMBUSTION ENGINE AND VEHICLE

FIELD OF THE INVENTION

The present invention relates to a four-cycle internal combustion engine having an exhaust gas re-circulation device (EGR), and a vehicle including such a four-cycle internal combustion engine.

DESCRIPTION OF THE RELATED ART

Conventionally, four-cycle internal combustion engines having an exhaust gas re-circulation device (EGR) for returning a portion of the exhaust gas (burnt gasses) to a combustion chamber are widely used. The EGR slows down combustion of a fuel/air mixture in a combustion chamber, lowers the highest combustion temperature, and reduces nitrogen oxides ($NO_X$). For example, an EGR including a gas storage chamber is known, in which an auxiliary exhaust valve is provided at an auxiliary exhaust port coupled to a combustion chamber and a portion of the burnt gasses (EGR gas) discharged via the auxiliary exhaust port is stored in the gas storage chamber (see JP-A-Hei 05-086992, page 6, FIGS. 17 and 18, for example). In such an EGR, the EGR gas stored in the storage chamber is returned to the combustion chamber at a predetermined timing.

A four-cycle internal combustion engine having the EGR disclosed in JP-A-Hei 05-086992 requires a main exhaust port and a main exhaust valve, and an auxiliary exhaust port and an auxiliary exhaust valve in addition. Therefore, there is a problem that the structure of a cylinder head is complicated and production cost becomes expensive especially with a multi-cylinder four-cycle internal combustion engine having a plurality of cylinder sections.

SUMMARY OF THE INVENTION

In order to overcome the problems described above, preferred embodiments of the present invention provide a four-cycle internal combustion engine having a plurality of cylinder sections in which a structure of a cylinder head is not complicated, fuel consumption can be improved, and nitrogen oxides (NOX) can be reduced, and also provide a vehicle including such a novel four-cycle internal combustion engine.

According to a preferred embodiment of the present invention, a four-cycle internal combustion engine includes a plurality of cylinder sections each including a cylinder and an exhaust passage in communication with the inside of the cylinder, in which the cylinder section is in communication with the exhaust passage and has a cylinder-sided passage section in communication with the exhaust passage, through which burnt gasses pass, and the engine further including an inter-cylinder passage in communication with a plurality of the cylinder-sided passage sections.

With such a four-cycle internal combustion engine, an internal EGR amount can be made larger than those in conventional cases, and thus a pumping loss decreases. Also, the four-cycle internal combustion engine has the cylinder-sided passage in communication with the exhaust passage through which burnt gasses pass, and the inter-cylinder passage in communication with a plurality of the cylinder-sided passages. Therefore, differently from a conventional EGR, the engine needs to have no special intake or exhaust passage in communication with a gas storage chamber, or an intake and exhaust valve.

With such unique features, the structure around a cylinder head is not complicated even though the engine has a plurality of cylinder sections, fuel consumption can be improved, and nitrogen oxides (NOX) can be reduced.

According to another preferred embodiment of the present invention, a four-cycle internal combustion engine is constructed in accordance with the preferred embodiment of the present invention described above, and such that a direction in which the burnt gasses are introduced into the cylinder-sided passage section is a direction along a periphery of the cylinder, as seen from an axial view of the cylinder.

It is preferable that the cylinder section includes an exhaust valve for opening or closing the exhaust passage; and a time period during which the exhaust valve of one cylinder section is opened overlaps at least partially another time period during which the exhaust valve of another cylinder section is opened.

The four-cycle internal combustion engine preferably includes a crankshaft and a valve actuating mechanism for opening or closing the exhaust valve at a predetermined period with rotation of the crankshaft.

It is also preferable that the cylinder section includes an intake passage in communication with the inside of the cylinder; a direction in which a fluid is taken into the inside of the cylinder via the intake passage is the direction along the periphery of the cylinder, as seen from the axial view of the cylinder; and a direction in which the burnt gasses are introduced corresponds to a direction in which the fluid is swirled about an center axis of the cylinder.

The cylinder section preferably includes an intake passage in communication with the inside of the cylinder, and an intake valve for opening or closing the intake passage, and a period during which the exhaust valve opens overlaps a period during which the intake valve opens.

The inter-cylinder passage preferably extends along an arrangement of the plurality of the cylinder sections, and the cylinder-sided passage section branches from the inter-cylinder passage and extends toward the exhaust passage.

The cylinder-sided passage section preferably is directed to an exhaust passage opening that is open to the inside of the cylinder.

It is preferable that the exhaust passage is formed in a cylinder head; and the inter-cylinder passage and the cylinder-sided passage section are formed, on an exhaust passage side, in the cylinder head.

The cylinder head preferably has a surface that is arranged to mate with a cylinder block which forms the cylinder; and the inter-cylinder passage has an opening portion that is open toward the mating surface.

The opening portion preferably is blocked in a manner such that the cylinder head and the cylinder block are assembled together.

According to another preferred embodiment of the present invention, a vehicle includes a four-cycle internal combustion engine according to any one of above-described preferred embodiments of the present invention.

According to various preferred embodiments of the present invention, a four-cycle internal combustion engine having plural number of cylinders further improves fuel consumption and reduction of nitrogen oxides (NOX) without the structure of the cylinder head being complicated, and also a vehicle includes such a novel four-cycle internal combustion engine is provided.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
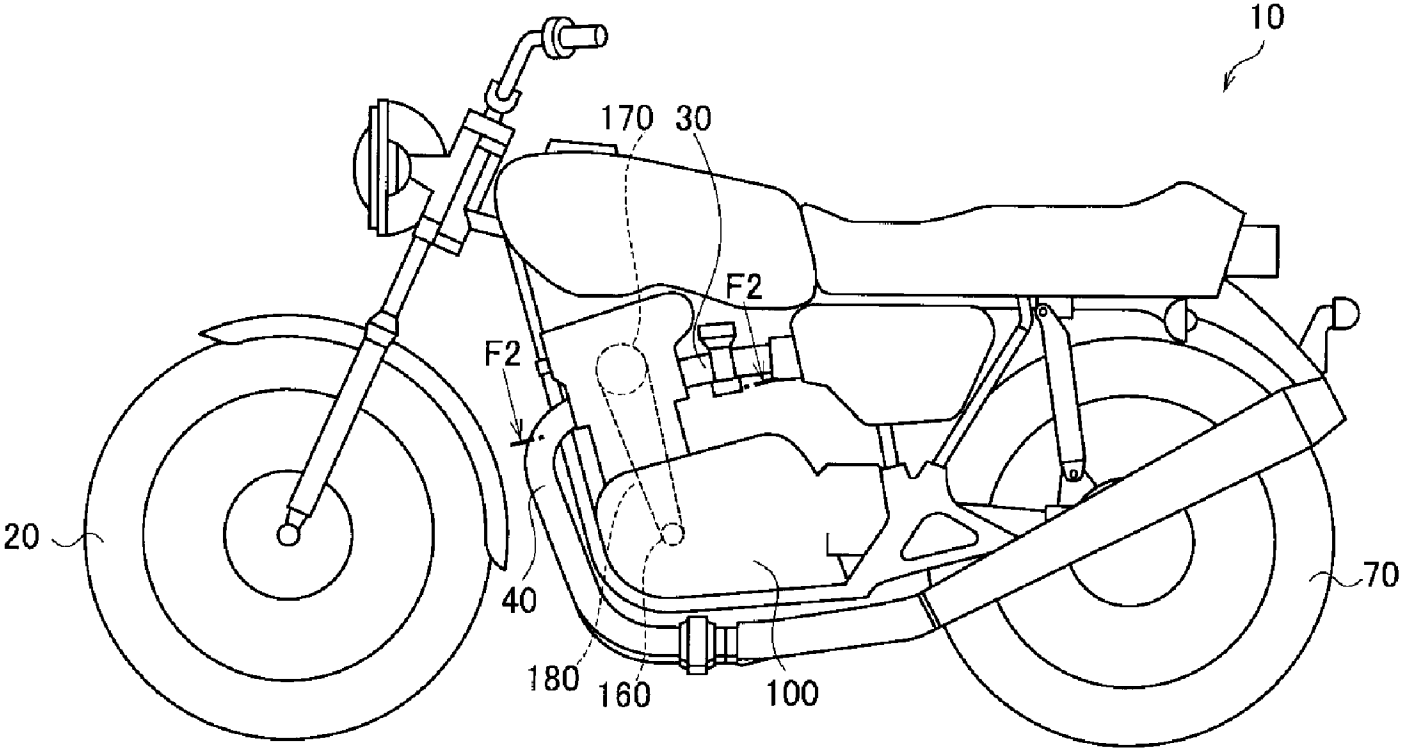
FIG. 1 is a left side view of a motorcycle according to a preferred embodiment of the present invention.

Next, preferred embodiments of the vehicle according to the present invention will be described with reference to the accompanying drawings. The same or similar reference numerals and symbols are given to the same or similar parts in expressions of the following drawings. However, attention should be paid on that the drawings are schematic figures and the proportions of the objects are different from the reality.

Therefore, specific sizes and so forth should be determined referring the following descriptions. Also, it is a matter of course that the relationships between sizes or the proportions of the objects are different mutually between the drawings.

(1) General Construction of the Whole

FIG. 1 is a left side view of a motorcycle 10 as a vehicle according to the present preferred embodiment. As shown in FIG. 1, the motorcycle 10 includes a front wheel 20 and a rear wheel 70. An engine 100 produces a driving force and drives the rear wheel 70.

The engine 100 preferably is a four-cycle engine. A sprocket 170 rotating together with a camshaft (not shown) is disposed above a cylinder head 110*sh* (not shown in FIG. 1, see FIG. 3) of the engine 100. In this preferred embodiment, the engine 100 preferably is constructed as a four-cycle internal combustion engine.

A cam chain 180 is engaged with a crankshaft 160, which is actually a sprocket (not shown) rotating together with the crankshaft 160, and the sprocket 170.

An intake pipe 30 in communication with intake ports 110in to 140 in (not shown in FIG. 1, see FIG. 2) is coupled to the engine 100. Also, an exhaust pipe 40 in communication with exhaust ports 110*ex* to 140*ex* is coupled to the engine 100.

(2) Construction of Four-Cycle Internal Combustion Engine

Figure 2:
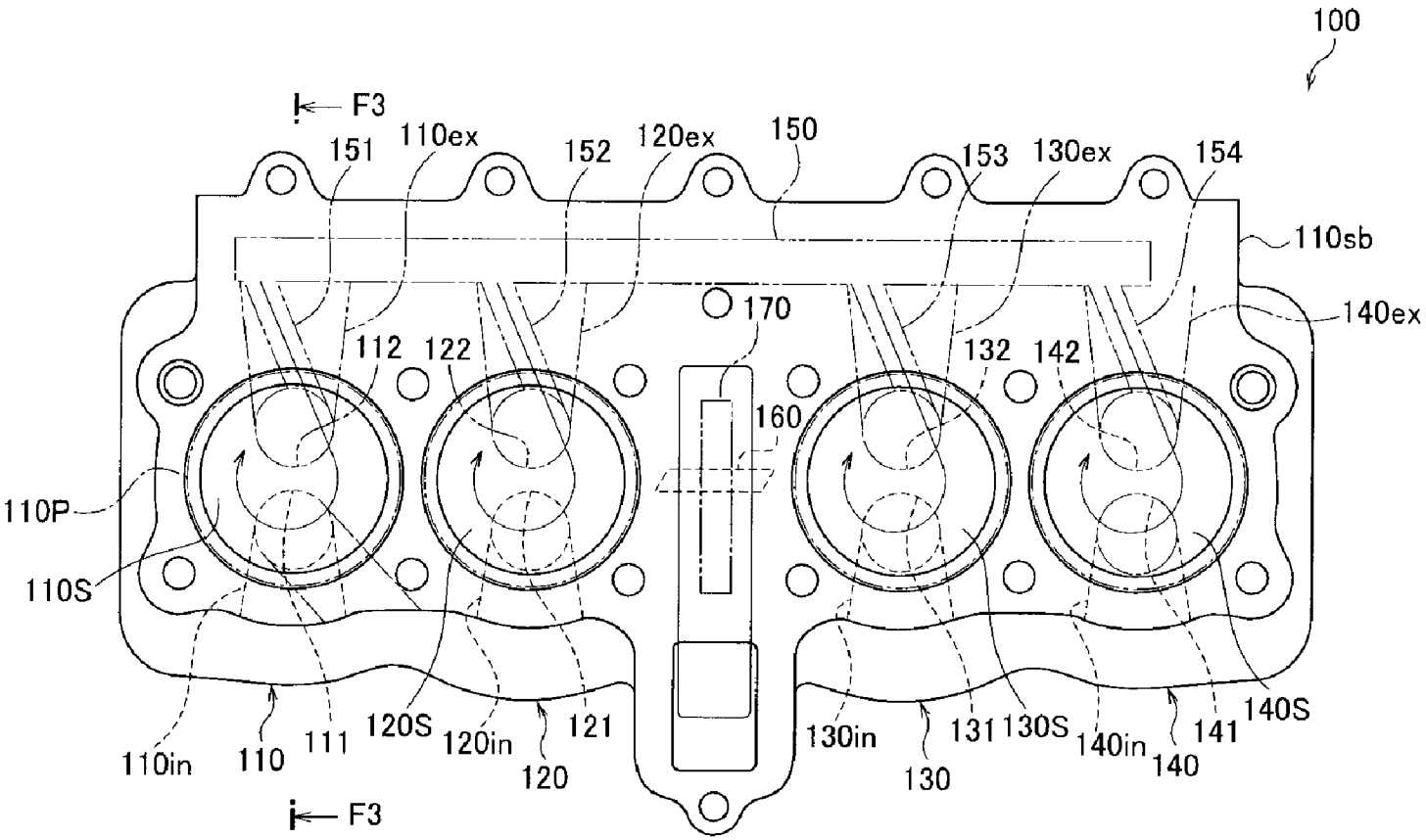
FIG. 2 is a plan view of the four-cycle internal combustion engine according to a preferred embodiment of the present invention.
Figure 3:
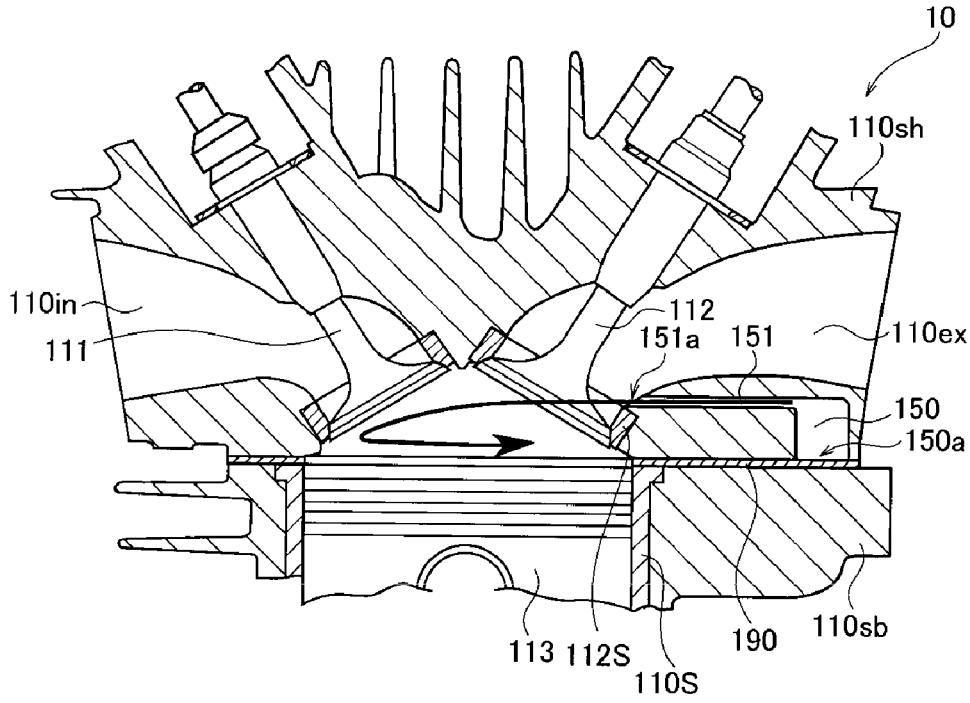
FIG. 3 is a cross sectional view in the F3-F3 direction shown in FIG. 2.

FIG. 2 is a plan view of the engine 100 preferably constructed as a four-cycle internal combustion engine in this preferred embodiment. Specifically, FIG. 2 is a plan view of the engine 100 in a position along the F2-F2 line shown in FIG. 1. FIG. 3 is a cross sectional view along the F3-F3 line shown in FIG. 2.

As shown in FIG. 2, the engine 100 preferably includes four cylinder sections, specifically, a first cylinder section 110, a second cylinder section 120, a third cylinder section 130, and a fourth cylinder section 140. The first cylinder section 110, the second cylinder section 120, the third cylinder section 130, and the fourth cylinder section 140 are arranged along the crankshaft 160. That is, the engine 100 preferably is a four-cylinder in-line engine.

The first cylinder section 110 has a cylinder 110S. Specifically, the cylinder 110S is formed with a cylinder block 110*sb* (see FIG. 3). A piston 113 is disposed inside the cylinder 110S.

The first cylinder section 110 has the intake port 110in and the exhaust port 110*ex*. Specifically, the intake port 110in and the exhaust port 110*ex* are formed with the cylinder head 110*sh* (see FIG. 3).

The intake port 110in is in communication with the inside of the cylinder 110S. In this preferred embodiment, the intake port 110in defines an intake passage.

Similarly to the intake port 110in, the exhaust port 110*ex* is in communication with the inside of the cylinder 110S. In this preferred embodiment, the exhaust port 110*ex* defines an exhaust passage.

As shown in FIG. 3, the intake port 110in and the exhaust port 110*ex* are formed in the cylinder head 110*sh*. An intake valve 111 is disposed at the intake port 110*in*. The intake valve 111 opens or closes the intake port 110*in* at a predetermined period.

An exhaust valve 112 is disposed at the exhaust port 110*ex*. The exhaust valve 112 opens or closes the exhaust port 110*ex* at a predetermined period.

A coil spring (not shown) for urging the intake valve 111 in a direction that closes the intake port 110*in* is mounted on the intake valve 111. Similarly, a coil spring (not shown) for urging the exhaust valve 112 in a direction that closes the exhaust port 110*ex* is mounted on the exhaust valve 112.

That is, the intake valve 111 opens or closes the intake port 110*in* at a predetermined period by rotation of the camshaft together with the sprocket 170. Similarly, the exhaust valve 112 opens or closes the exhaust port 110*ex* at a predetermined period by rotation of the camshaft together with the sprocket 170. In this preferred embodiment, the sprocket 170 and the cam chain 180 (see FIG. 1) define a valve actuating mechanism.

The second cylinder section 120, the third cylinder section 130, and the fourth cylinder section 140 each preferably have a construction that is substantially similar to the first cylinder section 110.

The second cylinder section 120 preferably has a cylinder 120S, the intake port 120 *in*, and the exhaust port 120*ex*. An intake valve 121 is disposed at the intake port 120*in*. An exhaust valve 122 is disposed at the exhaust port 120*ex*.

The third cylinder section 130 preferably has a cylinder 130S, the intake port 130 in, and the exhaust port 130*ex*. An intake valve 131 is disposed at the intake port 130*in*. An exhaust valve 132 is disposed at the exhaust port 130*ex*.

Similarly, the fourth cylinder section 140 preferably has a cylinder 140S, the intake port 140*in*, and the exhaust port 140*ex*. An intake valve 141 is disposed at the intake port 140*in*. An exhaust valve 142 is disposed at the exhaust port 140*ex*.

Each of the first cylinder section 110, the second cylinder section 120, the third cylinder section 130, and the fourth cylinder section 140 has a cylinder-sided passage in communication with the exhaust port, through which burnt gasses (EGR gas) pass. For example, the first cylinder section 110 has a cylinder-sided passage 151. Similarly, the second cylinder section 120, the third cylinder section 130, and the fourth cylinder section 140 have cylinder-sided passages 152, 153, and 154, respectively.

The cylinder-sided passages 151 to 154 are in communication with an inter-cylinder passage 150. That is, the inter-cylinder passage 150 is in communication with a plurality of the cylinder-sided passages. The inter-cylinder passage 150 is arranged along the axial direction of the crankshaft 160 so as to extend in a direction in which a plurality of the cylinders is arranged.

As shown in FIG. 2, the cylinder-sided passages 151 to 154 are obliquely coupled to the inter-cylinder passage 150 formed along the axial direction of the crankshaft 160 in a plan view of the engine 100. The cylinder-sided passages 151 through 154 branch out from the inter-cylinder passage 150, and extend toward the exhaust ports 110*ex* to 140*ex*.

As shown in FIG. 3, an opening 151*a* of the cylinder-sided passage 151 adjoins the top end of an annular exhaust valve seat 112S. Burnt gasses discharged from the opening 151*a* toward the cylinder-sided passage 151 are supplied to another cylinder (specifically, the third cylinder section 130) via the cylinder-sided passage 151 and the inter-cylinder passage 150. The cylinder-sided passage 151 is directed to an opening portion of the exhaust port 110*ex* that is open to the cylinder 110S, specifically a gap inside the exhaust valve seat 112S.

The inter-cylinder passage 150 and the cylinder-sided passage 151 are formed in the cylinder head 110*sh* on the side that the exhaust port 110*ex* is formed.

Burnt gasses supplied from another cylinder section (specifically, the second cylinder section 120) via the inter-cylinder passage 150 and the cylinder-sided passage 151 are introduced into the inside of the cylinder 110S through the opening 151*a*. The direction of the cylinder-sided passage 151, specifically, a direction of the burnt gasses introduced into the cylinder 110S through the opening 151*a*, is a direction along a periphery 110*p* of the cylinder 110S (see FIG. 2) viewing the cylinder 110S in its axial direction (the direction shown in FIG. 2).

The cylinder head 110*sh* and the cylinder block 110*sb* are coupled together through a gasket 190. That is, the cylinder head 110*sh* has a surface mating with the cylinder block 110*sb*, which is a plain surface contacting the gasket 190 in this preferred embodiment.

Further, the inter-cylinder passage 150 has an opening 150*a* open to the surface mating with the cylinder block 110*sb*. The inter-cylinder passage 150 defines a closed space in such a manner that the cylinder head 110*sh* and the cylinder block 110*sb* are combined together to block the opening 150*a*.

The volume (a cross sectional area in the direction of a smaller diameter) of the inter-cylinder passage 150 is larger than that of the cylinder-sided passage 151 (152, 153 or 154). In addition, the cylinder-sided passages 152, 153, 154 each have a shape similar to the cylinder-sided passage 151.

Operation of Four-Cycle Internal Combustion Engine

Next, an operation of the engine 100 of the four-cycle internal combustion engine in this preferred embodiment will be described. Specifically, descriptions will be made about a flow of burnt gasses occurring with operations of the intake valves and the exhaust valves of the engine 100.

Figure 4:
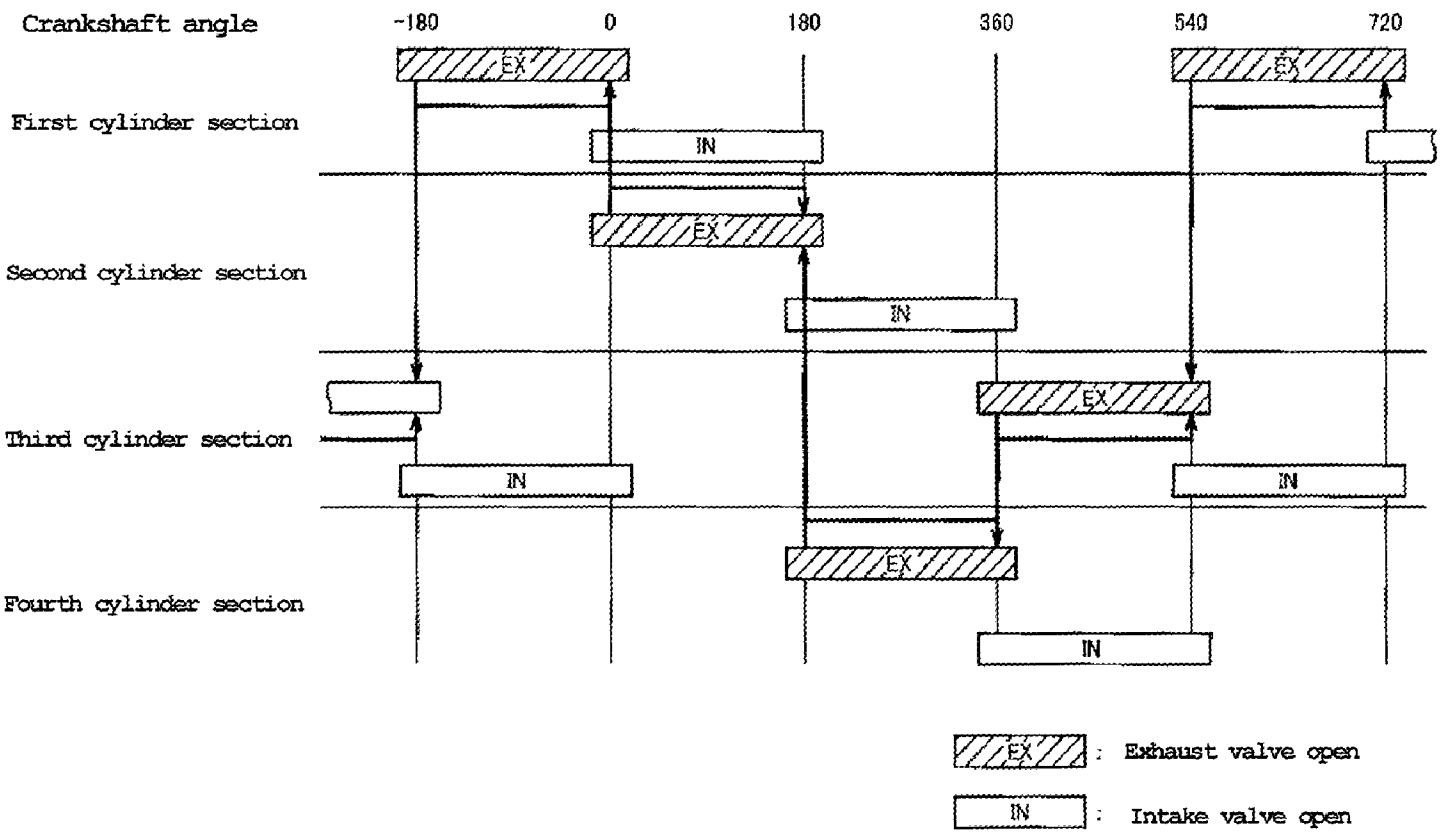
FIG. 4 is an explanatory diagram, explaining about flows of burnt gasses occurring with operations of intake valves and exhaust valves of the four-cycle internal combustion engine according to a preferred embodiment of the present invention.

FIG. 4 shows operation timings of the intake valves and the exhaust valves of the engine 100. As shown in FIG. 4, the engine 100 repeats explosions in order of the first cylinder section 110, the second cylinder section 120, the fourth cylinder section 140, and the third cylinder section 130 (see "exhaust valve open" and "intake valve open" timings in the figure).

In FIG. 4, arrows show flows of burnt gasses. For example, when the exhaust valve 112 of the first cylinder section 110 is open, burnt gasses flowing from the cylinder 110S into the cylinder-sided passage 151 are supplied to the cylinder 130S of the third cylinder section 130 via the inter-cylinder passage 150 and the cylinder-sided passage 153. Further, in FIG. 4, as an arrow directs toward the exhaust valve 112 of the first cylinder section 110, a portion of the burnt gasses flowing from the cylinder 110S into the cylinder-sided passage 151 returns from the cylinder-sided passage 151 to the cylinder 110S.

A period during which the exhaust valve of any one of the cylinder sections opens, for example, the exhaust valve 112 opens in the first cylinder section 110 overlaps at least partially a period during which the exhaust valve of the cylinder section other than the first cylinder section 110, specifically, the exhaust valve 132 of the third cylinder section 130 opens.

That is, the engine 100 includes the four cylinder sections (the first cylinder section 110, the second cylinder section 120, the third cylinder section 130, and the fourth cylinder section 140). A period during which an exhaust valve (the exhaust valve 112) in any one of the cylinder sections (for example, the first cylinder section 110) opens overlaps at least partially a period during which an exhaust valve (the exhaust valve 132) opens.

Also, in each of the cylinder sections, a period during which the exhaust valve opens overlaps a period during which the intake valve opens.

With the engine 100, an internal EGR amount can be made larger than that in a conventional exhaust gas re-circulation device (EGR), and thus a pumping loss can be reduced. Therefore, a throttle valve (not shown) of the engine 100 is set more open, thereby improving the fuel consumption.

The engine 100 has the cylinder-sided passages 151 to 154 in communication with the exhaust ports through which burnt gasses pass, and the inter-cylinder passage 150 in communication with the cylinder-sided passages 151 to 154. Therefore, differently from a conventional EGR, the engine needs to have no special intake and exhaust passage in communication with a gas storage chamber, or no intake and exhaust valve.

That is, with the engine 100, in the case that the engine has a plurality of cylinders (the cylinders 110S, 120S, 130S, 140S), the construction of the cylinder head 110*sh* is not complicated, the fuel consumption can be improved, and nitrogen oxides (NOX) can be reduced.

In this preferred embodiment, the direction of burnt gasses discharged from the cylinder-sided passage into the inside of the cylinder is the direction along the periphery (for example, the periphery 110*p*) of the cylinder. Therefore, burnt gasses can be discharged to swirl along the periphery of the cylinder. That is, in the engine 100, unburned gasses in a quenching area (not shown) are reduced by the burnt gasses, and thus the amount of HC production can be reduced. Further, in the engine 100, the burnt gasses are discharged (refluxed) and swirled inside of the cylinder, and thus burnt gasses flowing near the periphery and a fresh fuel/air mixture flowing from the intake port can be stratified.

More specifically, the engine 100 improves an EGR rate (a value obtained by dividing an amount of burnt gasses refluxed into the inside of the cylinder by an amount of an intake air). Therefore, this contributes to a further improvement in the fuel consumption and cleanup of exhaust gas.

In this preferred embodiment, a period during which an exhaust valve of a certain cylinder section, for example, the exhaust valve 112 of the first cylinder section 110, opens overlaps a period during which an exhaust valve of a cylinder section other than the first cylinder section 110, specifically, the exhaust valve 132 of the third cylinder section 130, opens. That is, burnt gasses produced in the certain cylinder section are immediately supplied to another cylinder section. Therefore, this contributes to a further improvement in the fuel consumption and cleanup of exhaust gas.

The content of the present invention has thus far been disclosed with respect to the above-described preferred embodiment of the present invention. However, it should be recognized that no part of the descriptions and drawings of this disclosure limits the present invention. Those skilled in this art will appreciate that various alternative embodiments may be made or derived from the present disclosure.

For example, the direction of introducing a fluid, specifically a fuel/air mixture, into the inside of the cylinder via the intake port, is preferably along the periphery of the cylinder 110S viewing the cylinder 110S in its axial direction. The direction of introducing burnt gasses can be the same as a swirl direction of the fuel/air mixture in the case that the axis of the cylinder 110S is the rotational center. For example, in the first cylinder section 110 shown in FIG. 2, the shape of the intake port 110in can be modified into a shape shown by the one-dot chain-line so that the direction of introducing a fuel/air mixture inside of the cylinder 110S via the intake port 110in is made generally the same as the direction of introducing the burnt gasses.

In this case, it is preferred that the period during which the exhaust valve opens overlaps a period during which the intake valve opens. With a modification in such a manner, a swirl flow of burnt gasses discharged inside of the cylinder can be enhanced.

While the period during which the exhaust valve of a certain cylinder section opens overlaps the period during which the exhaust valve of a cylinder other than the certain cylinder opens in the above preferred embodiment, both periods do not necessarily need to overlap.

In the above preferred embodiment, the direction of discharging burnt gasses from the cylinder-sided passage into the inside of the cylinder is along the periphery (for example, the periphery 110*p*) of the cylinder. However, the direction of discharging burnt gasses does not necessarily need to be along the periphery of the cylinder.

In the above preferred embodiment, the engine 100 preferably is an in-line four-cylinder engine. However, the engine 100 is not limited to the in-line four-cylinder engine, but can be an in-line six-cylinder engine, or a V-type eight-cylinder engine. Further, the engine 100 does not necessarily have to be an even number cylinder in-line engine. For example, the engine 100 can be a three-cylinder engine or a five-cylinder engine.

In the above preferred embodiments, the descriptions are made with the motorcycle 10 serving as an example. However, it is a matter of course that the present invention can be applied to vehicles other than a motorcycle, for example, an engine (a four-cycle internal combustion engine) carried on a four wheeled motor vehicle.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A four-cycle internal combustion engine comprising:

a plurality of cylinder sections each including a cylinder and an exhaust passage in communication with an inside of the cylinder via an exhaust passage opening, each of the cylinder sections being in communication with the respective exhaust passage and including a cylinder-sided passage section in communication with the respective exhaust passage through which burnt gasses pass; and an inter-cylinder passage in communication with the cylinder-sided passage sections; wherein each of the cylinder-sided passage sections is directed toward the respective exhaust passage opening and toward a periphery of the inside of the respective cylinder such that the burnt gasses are discharged from the cylinder-sided passage and through the respective exhaust passage opening so as to swirl along the periphery of the inside of the respective cylinder.

2. The four-cycle internal combustion engine according to claim 1, wherein a direction in which the burnt gasses are introduced into the cylinder-sided passage section is a direction along a periphery of the cylinder, as seen from an axial view of the cylinder.

3. The four-cycle internal combustion engine according to claim 1, wherein each of the cylinder sections includes an exhaust valve arranged to open or close the respective exhaust passage, and a time period during which the exhaust valve of one cylinder section is opened overlaps at least partially another time period during which the exhaust valve of another cylinder section is opened.

4. The four-cycle internal combustion engine according to claim 3, further comprising:

a crankshaft; and a valve actuating mechanism arranged to open or close the exhaust valve at a predetermined period with rotation of the crankshaft.

5. The four-cycle internal combustion engine according to claim 2, wherein the cylinder section includes an intake passage in communication with the inside of the cylinder, a direction in which a fluid is taken into the inside of the cylinder via the intake passage is the direction along the periphery of the cylinder, as seen from the axial view of the cylinder, and a direction in which the burnt gasses are introduced corresponds to a direction in which the fluid is swirled about a center axis of the cylinder.

6. The four-cycle internal combustion engine according to claim 3, wherein the cylinder section includes an intake passage in communication with the inside of the cylinder, and an intake valve for opening or closing the intake passage, and a period during which the exhaust valve opens overlaps a period during which the intake valve opens.

7. The four-cycle internal combustion engine according to claim 1, wherein the inter-cylinder passage extends along an arrangement of the plurality of the cylinder sections, and the cylinder-sided passage section branches from the inter-cylinder passage and extends toward the exhaust passage.

8. The four-cycle internal combustion engine according to claim 1, wherein the exhaust passage is located in a cylinder head, and the inter-cylinder passage and the cylinder-sided passage section are located in the cylinder head on an exhaust passage side.

9. The four-cycle internal combustion engine according to claim 8, wherein the cylinder head has a surface arranged to mate with a cylinder block which defines the cylinder, and the inter-cylinder passage has an opening portion that is open toward the mating surface.

10. The four-cycle internal combustion engine according to claim 9, wherein the opening portion is blocked in a manner such that the cylinder head and the cylinder block are assembled together.

11. A vehicle comprising the four-cycle internal combustion engine according to claim 1.

12. The four-cycle internal combustion engine according to claim 9, wherein the inside of the cylinder defines a combustion chamber surrounded by a cylinder head, a cylinder block, and a piston reciprocating within the cylinder block.

* * * * *